US011643851B2

(12) United States Patent
Kothe

(10) Patent No.: US 11,643,851 B2
(45) Date of Patent: May 9, 2023

(54) MOTOR VEHICLE LOCK

(71) Applicant: Brose Schliesssysteme GmbH & Co. Kommanditgesellschaft, Wuppertal (DE)

(72) Inventor: Markus Kothe, Velbert (DE)

(73) Assignee: Brose Schliesssysteme GmbH & Co. Kommanditgesellschaft, Wuppertal (DE)

( * ) Notice: Subject to any disclaimer, the term of this patent is extended or adjusted under 35 U.S.C. 154(b) by 1240 days.

(21) Appl. No.: 15/754,745

(22) PCT Filed: Aug. 22, 2016

(86) PCT No.: PCT/EP2016/069800
§ 371 (c)(1),
(2) Date: Jul. 17, 2018

(87) PCT Pub. No.: WO2017/032742
PCT Pub. Date: Mar. 2, 2017

(65) Prior Publication Data

US 2018/0355641 A1 Dec. 13, 2018

(30) Foreign Application Priority Data

Aug. 25, 2015 (DE) ..... 20 2015 104 502.6

(51) Int. Cl.
*E05B 79/10* (2014.01)
*E05B 81/16* (2014.01)
(Continued)

(52) U.S. Cl.
CPC ..... *E05B 79/10* (2013.01); *E05B 15/004* (2013.01); *E05B 77/06* (2013.01); *E05B 79/20* (2013.01);
(Continued)

(58) Field of Classification Search
CPC ..... E05B 79/10; E05B 15/004; E05B 77/06; E05B 79/20; E05B 81/16; E05B 81/06;
(Continued)

(56) References Cited

U.S. PATENT DOCUMENTS 6,519,986 B2 * 2/2003 Wicker ..... E05B 81/06 292/201
6,648,380 B1 * 11/2003 Szablewski ..... E05B 81/14 292/201
(Continued)

FOREIGN PATENT DOCUMENTS

DE 19631869 2/1998
DE 19841670 3/2000
(Continued)

OTHER PUBLICATIONS

"German Search Report," for Priority Application No. DE202015104502.6 (corresponding to our file) dated Jun. 16, 2016 (5 pages).
(Continued)

*Primary Examiner* — Christine M Mills
*Assistant Examiner* — Faria F Ahmad
(74) *Attorney, Agent, or Firm* — Pauly, DeVries Smith & Deffner LLC

(57) ABSTRACT

Various embodiments provide a vehicle lock with a supporting structure for holding at least one locking element and a lock mechanism, wherein the lock mechanism can be put into different function states and has a function element that can be moved into different function positions, wherein a drive assembly having a drive train to the function element is provided, wherein an actuating element is provided, by the actuating motion of which said locking element can be actuated, wherein the function element in one function position guides the actuating motion of the actuating ele-
(Continued)

ment either into a free-movement path, in which the actuating element moves freely, or into an actuation path, in which the actuating element actuates the locking element, and for this purpose applies a guiding force to the actuating element, the force flow of which guiding force runs outside of the drive train of the drive assembly.

20 Claims, 6 Drawing Sheets

(51) Int. Cl.
*E05B 15/00* (2006.01)
*E05B 77/06* (2014.01)
*E05B 79/20* (2014.01)
*E05B 81/06* (2014.01)

(52) U.S. Cl.
CPC ..... *E05B 81/16* (2013.01); *E05B 81/06* (2013.01); *Y10S 292/23* (2013.01); *Y10T 292/0849* (2015.04); *Y10T 292/108* (2015.04); *Y10T 292/1082* (2015.04); *Y10T 292/1092* (2015.04)

(58) Field of Classification Search
CPC ..... Y10S 292/23; Y10T 292/108; Y10T 292/1082; Y10T 292/1092; Y10T 292/0849
See application file for complete search history.

(56) References Cited

U.S. PATENT DOCUMENTS

| | | | | |
|---|---|---|---|---|
| 7,261,335 | B2 * | 8/2007 | Schupp | E05B 77/02 292/201 |
| 7,503,598 | B2 * | 3/2009 | Graute | E05B 77/38 292/201 |
| 8,608,212 | B2 * | 12/2013 | Takeda | E05B 81/64 292/201 |
| 9,677,302 | B2 * | 6/2017 | Coleman | E05B 81/15 |
| 9,784,021 | B2 * | 10/2017 | Torka | E05B 81/14 |
| 9,874,046 | B2 * | 1/2018 | Wittelsbuerger | E05B 85/243 |
| 10,745,944 | B2 * | 8/2020 | Bendel | E05B 81/06 |
| 10,837,205 | B2 * | 11/2020 | Ishiguro | E05B 83/18 |
| 10,865,589 | B2 * | 12/2020 | Pettengill | E05B 81/15 |
| 2002/0157435 | A1 | 10/2002 | Wicker | |
| 2003/0116977 | A1 * | 6/2003 | Erices | E05B 81/06 292/201 |
| 2003/0164616 | A1 * | 9/2003 | Belmond | E05B 77/12 292/201 |
| 2004/0227359 | A1 * | 11/2004 | Coleman | E05B 77/26 292/254 |
| 2006/0131894 | A1 * | 6/2006 | Graute | E05B 77/40 292/216 |
| 2010/0133856 | A1 * | 6/2010 | Helisten | E05B 47/0607 292/144 |
| 2010/0170308 | A1 * | 7/2010 | Wattebled | E05B 81/20 70/77 |
| 2010/0283268 | A1 * | 11/2010 | Cumbo | E05B 77/12 292/196 |
| 2014/0132008 | A1 * | 5/2014 | Bendel | E05B 77/06 292/92 |
| 2014/0284942 | A1 * | 9/2014 | Wittelsbuerger | E05B 85/243 292/92 |
| 2015/0204118 | A1 | 7/2015 | Cetnar | |
| 2015/0233156 | A1 * | 8/2015 | Scholz | E05B 85/20 292/200 |
| 2015/0300052 | A1 * | 10/2015 | Barmscheidt | E05B 79/10 292/201 |
| 2016/0090759 | A1 * | 3/2016 | Rosales | E05B 85/26 292/220 |
| 2016/0258193 | A1 * | 9/2016 | Rosales | E05B 77/06 |
| 2016/0281394 | A1 * | 9/2016 | Bendel | E05B 81/06 |
| 2019/0249467 | A1 * | 8/2019 | Patane | E05B 81/14 |
| 2019/0271179 | A1 * | 9/2019 | Patane | E05B 81/14 |
| 2019/0338568 | A1 * | 11/2019 | Klein | E05B 79/20 |
| 2020/0362599 | A1 * | 11/2020 | Rosales | E05B 81/30 |

FOREIGN PATENT DOCUMENTS

| | | |
|---|---|---|
| DE | 10139975 | 4/2002 |
| DE | 102004014550 | 10/2005 |
| DE | 102013110756 | 4/2015 |
| WO | 2013170363 | 11/2013 |
| WO | 2017032742 | 3/2017 |

OTHER PUBLICATIONS

"International Preliminary Report on Patentability," for PCT Application No. PCT/EP2016/069800 (corresponding to our file) dated Feb. 27, 2018 (6 pages).
"International Search Report and Written Opinion," for PCT Application No. PCT/EP2016/069800 (corresponding to our file) dated Nov. 14, 2016 (8 pages).

* cited by examiner

MOTOR VEHICLE LOCK

CROSS-REFERENCE TO RELATED APPLICATIONS

This application is a national stage application under 35 U.S.C. 371 of International Patent Application Serial No. PCT/EP2016/069800, entitled "Motor Vehicle Lock," filed Aug. 22, 2016, which claims priority from German Patent Application No. DE 20 2015 104 502.6, filed Aug. 25, 2015, the disclosure of which is incorporated herein by reference.

FIELD OF THE TECHNOLOGY

The disclosure relates to a motor vehicle lock.

BACKGROUND

Many motor vehicle locks are known from the prior art. Motor vehicle locks find application in all kinds of closure elements of a motor vehicle. They include, in particular, side doors, rear doors, hatchbacks, tailgates or engine hoods. These closure elements may also be designed basically in the style of sliding doors.

In DE 10 2004 014 550 A1, for example, a motor vehicle lock with the locking elements of a pawl and a latch is described. The motor vehicle lock has a lock mechanism. This can be placed in various function states. The lock mechanism has a function element which can be spring-deflected into different function positions corresponding to the function states. The function element can be placed by motor in the different function positions. During the movement between the different function positions, the restoring force of the function element acts fully on the drive train of the drive. As a result, relatively strong and thus costly drives are required for the moving of the function element for a secure adjusting of the function states.

SUMMARY

One of the problems which the present disclosure proposes to solve is to design and modify a motor vehicle lock so that the different function states can be implemented in an economical manner.

The above problem can be solved in a motor vehicle lock as described herein.

By providing a free-movement path, in which the actuating element runs free, and an actuation path, in which the actuating element actuates the locking element, it is easily possible to provide for different function states in that a function element guides the actuating motion either in the free-movement path or in the actuation path. For this purpose, the function element can apply a guiding force to the actuating element.

Since the force flow of the guiding force runs outside of the drive train of the drive assembly, only slight driving forces are needed for the moving of the function element. Guiding forces or actuating forces for the actuating element need not be absorbed by the drive train. Therefore, the drive for the function element can be designed to be correspondingly small and economical.

According to one modification, it is proposed that the function element in one function position releases the actuating motion of the actuating element in the free-movement path or releases it in the actuation path. Thanks to the simple setting of a deflection, the two function states are realized in an especially simple manner. The function element may have a guide contour for the guiding of the actuating element.

In order to heighten the crash safety of the motor vehicle lock, according to some embodiments the motor vehicle lock can be configured and designed such that, in an "unlocked" function position, the inertia of the actuating element produces a movement of the actuating element on the free-movement path if the speed of the actuating motion exceeds a speed threshold, and produces a movement of the actuating element on the actuation path if the speed of the actuating motion is below a speed threshold.

In order to have the weakest possible design for the drive, according to some embodiments it may be provided that the axis of rotation of the function element is at most 2 cm, such as at most 1 cm, distant from the center of mass of the function element. Further, the axis of rotation of the function element is led through the center of mass of the function element.

Various embodiments provide a motor vehicle lock with a supporting structure for holding at least one locking element and a lock mechanism, wherein the lock mechanism can be put into different function states and, for this purpose, has a function element that can be moved into different function positions corresponding to the function states, wherein a drive assembly having a drive train to the function element is provided for the motorized adjustment of the function element, wherein an actuating element is provided, by means of the actuating motion of which said locking element can be actuated, wherein the function element in one function position guides the actuating motion of the actuating element either into a free-movement path, in which the actuating element moves freely, or into an actuation path, in which the actuating element actuates the locking element, and for this purpose applies a guiding force to the actuating element, the force flow of which guiding force runs outside of the drive train of the drive assembly.

In various embodiments, the locking element which is actuated on the actuation path by the actuating element is a pawl.

In various embodiments, the actuating element in the actuating of the locking element acts on the locking element in gear-free manner, and/or that the actuating element in the actuating of the locking element acts directly on the locking element.

In various embodiments, the free-movement path and the actuation path run along-side each other, such as the free-movement path and the actuation path run in the direction of the axis of rotation of a locking element or run alongside each other offset transversely to the axis of rotation of a locking element.

In various embodiments, the function element has a guide contour for guiding the actuating element. In some embodiments, the guide contour can be surface-treated, such as coated, further in that the guide contour can be coated with plastic material, especially a thermoplastic polyester elastomer and/or a polymer bearing material.

In various embodiments, the function element in one function position releases the actuating motion of the actuating element in the free-movement path or releases it in the actuation path.

In various embodiments, the motor vehicle lock has a spring assembly acting on the actuating element, such as in that the spring assembly prestresses the actuating element in at least one function position of the function element against the function element.

In various embodiments, the spring assembly prestresses the actuating element on the actuation path.

In various embodiments, the lock mechanism provides the functions "locked" and "unlocked", especially through function positions of the function element, such as in that the motor vehicle lock additionally provides the function "child protection" and/or "theft protection", especially through function positions of the function element.

In various embodiments, the motor vehicle lock is configured and designed such that, in an "unlocked" function position, the inertia of the actuating element produces a movement of the actuating element on the free-movement path if the speed of the actuating motion exceeds a speed threshold, and produces a movement of the actuating element on the actuation path if the speed of the actuating motion is below a speed threshold.

In various embodiments, the drive drives the function element in the manner of a direct drive and/or in that the drive assembly is at least partly integrated in the function element.

In various embodiments, the function element is moved by rotation and/or in linear motion between its function positions, such as in that the axis of rotation of the function element is oriented parallel, especially coaxially, to the axis of rotation of a locking element and/or to the axis of turning of the drive.

In various embodiments, the motor vehicle lock comprises a bearing bolt, around which the function element can move in rotation, such as in that the bearing bolt forms the stator material, and/or in that the force flow of the guiding force is diverted by the bearing bolt outside of the drive train of the drive assembly.

In various embodiments, the axis of rotation of the function element is at most 2 cm, such as at most 1 cm, distant from the center of mass of the function element, further in that the axis of rotation of the function element leads through the center of mass of the function element.

In various embodiments, the motor vehicle lock has another actuating element for opening the motor vehicle lock, such as in that the other actuating element for opening the motor vehicle lock likewise acts on the function element.

In various embodiments, the actuating element comprises a rod and/or a Bowden cable or is designed as a rod or Bowden cable.

BRIEF DESCRIPTION OF THE FIGURES

The disclosure shall be described more closely below with the aid of one drawing representing only one sample embodiment. The drawing shows FIG. 1 a motor vehicle lock as proposed in a schematic representation in the "locked" function state with actuating element not actuated, FIG. 2 the motor vehicle lock of FIG. 1 in the "locked" function state upon actuating of the actuating element, FIG. 3 the motor vehicle lock of FIG. 1 in the "unlocked" function state upon actuating of the actuating element shortly before the start of the lifting of the pawl, FIG. 4 the motor vehicle lock of FIG. 1 in the "unlocked" function state upon actuating of the actuating element after the lifting of the pawl in the opened state, FIG. 5 the motor vehicle lock of FIG. 1, the pawl having just been lifted by motor, FIG. 6 an exploded drawing of the components of the motor vehicle lock of FIG. 1 secured to the bearing bolt.

DETAILED DESCRIPTION

Figure 1:
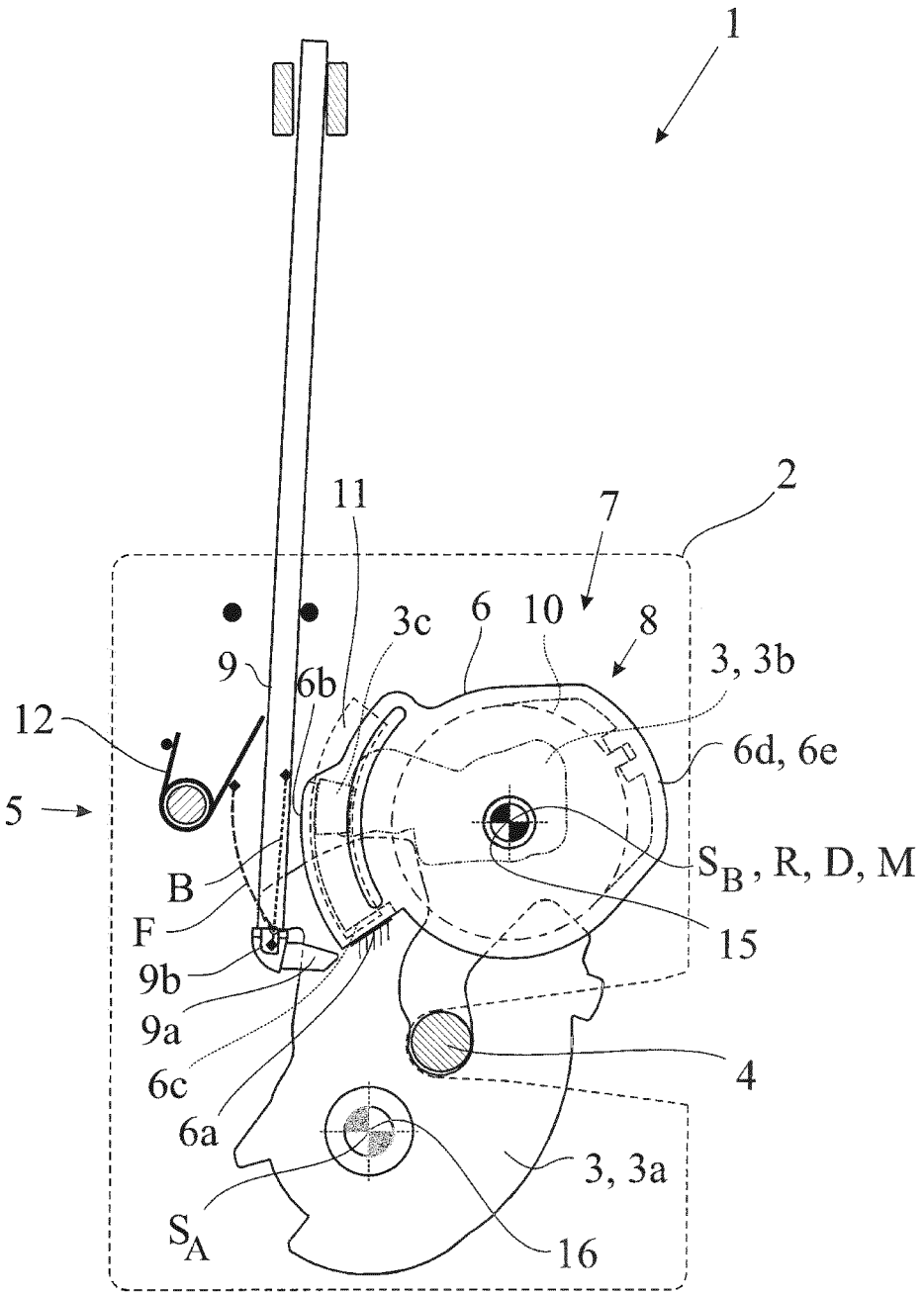

FIG. 1 shows schematically a proposed motor vehicle lock 1. With the motor vehicle lock 1, the most varied closure elements of a motor vehicle can be held in place. In this regard, reference is made to the introductory passage.

The motor vehicle lock 1 has a supporting structure 2 to hold at least one locking element 3 and a lock mechanism 4. The supporting structure 2 can be connected firmly to a housing of the motor vehicle lock 1, not shown, or it may form part of a housing of the motor vehicle lock 1, not shown.

Here, the locking elements 3 of the latch 3*a* and the pawl 3*b* are arranged on the supporting structure 2. The latch 3*a* and the pawl 3*b* interact in customary fashion with a striker 5 in order to hold a closure element in place.

The lock mechanism 4 can be placed in various function states. For this purpose, the lock mechanism 4 has a function element 6 that can be moved into different function positions corresponding to the function states. The function element 6 can be formed from plastic. In some embodiments, the function element 6 is formed from injection-molded plastic.

For the motorized adjustment of the function element 6 there is provided a drive assembly 7 with a drive train 8 to the function element 6. For at least one function position of the function element 6, an end stop 6*a* may be provided. Furthermore, end stops may be provided for other, especially for all, function positions of the function element 6.

Moreover, the motor vehicle lock 1 has an actuating element 9, by whose actuating motion the at least one locking element 3, especially the pawl 3*b*, can be actuated. In the sample embodiment, the actuating of the locking element 3 is the lifting of the pawl 3*b*. In some embodiments, the actuating element 9 is actuated by an actuating lever, not shown, especially by an outer door handle or an inner door handle.

The motor vehicle lock 1 can additionally have a further actuating element, not shown, by whose actuating motion the at least one locking element 3, especially the pawl 3*b*, can be actuated. In some embodiments, the further actuating element 9, not shown, is actuated by a further actuating lever, not shown, especially an inner door handle.

The function element 6 in one function position can guide the actuating motion of the actuating element 9 either into a free-movement path F, in which the actuating element 9 moves freely, or into an actuation path B, in which the actuating element 9 actuates the locking element 3. In some embodiments, the actuating element 9 actuates the locking element 3 by means of an engagement contour 9*a*. This may be formed as a lug. Further paths, especially for further function states, can be provided in the lock mechanism 5 for the actuating element 9.

Because the different function states of the motor vehicle lock 1 are provided through the free-movement path F or the actuation path B, the lock mechanism 5 can have a mechanically weak design. The components of the lock mechanism 5 need not be dimensioned to accommodate blocking forces inside the lock mechanism 5.

For the guiding of the actuating element 9, the function element 6 applies a guiding force to the actuating element 9. The force flow of the guiding force runs outside of the drive train 8 of the drive assembly 7. In this way, the drive train 8 need not absorb any guiding forces and/or actuating forces of the actuating element 9 to provide the function states. The drive 10 need only move the function element 6 and possibly with-stand friction forces due to the sliding of the actuating element 9. Accordingly, it can have a weak design.

Here, the locking element or elements 3 are situated in a different plane of the motor vehicle lock 1 than the function element 6. The actuating element 6 can move in the plane of the function element 6.

Figure 6:
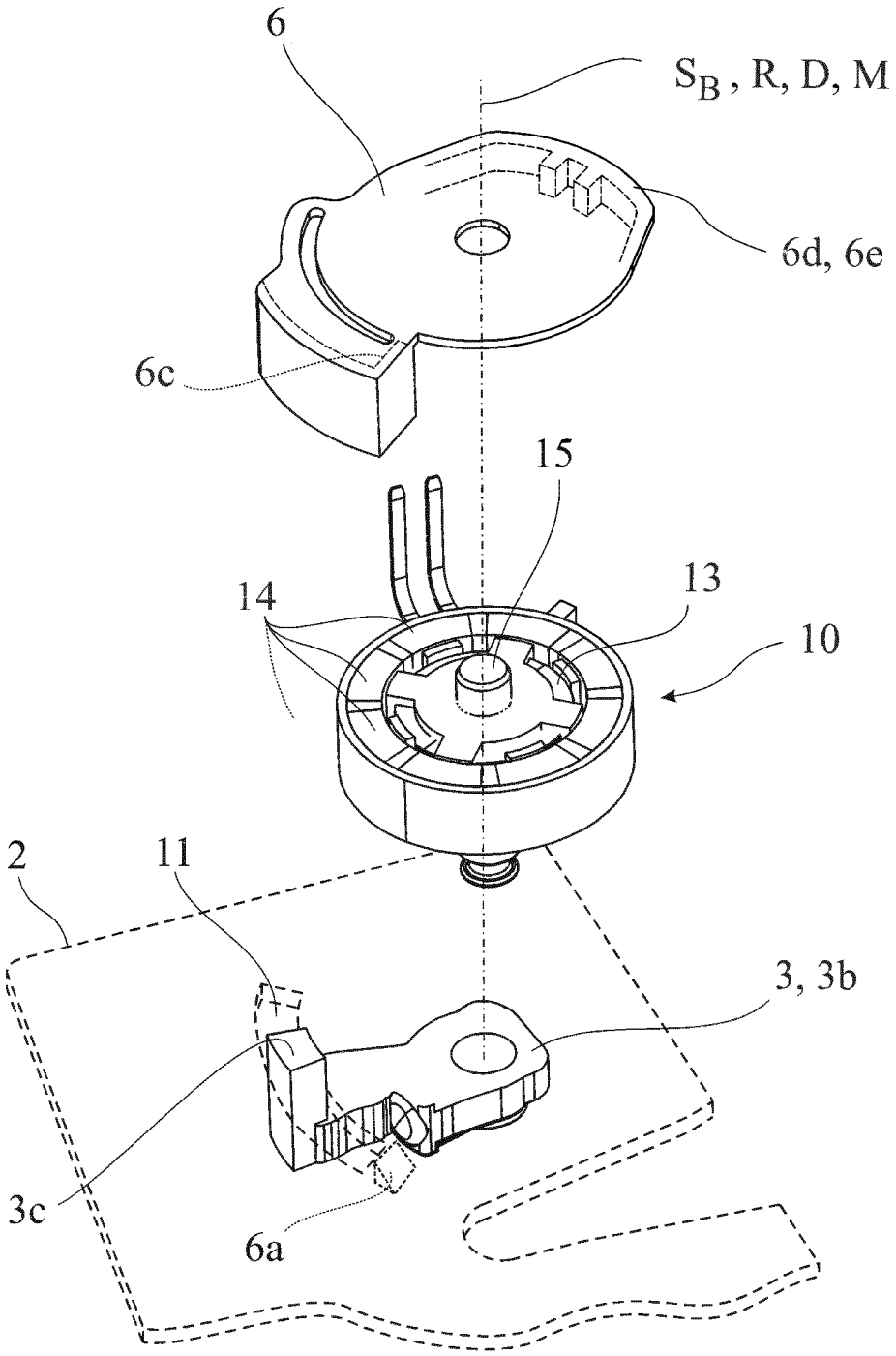

As shown in the sample embodiment of FIG. 6, the locking elements 3 and the function element 6 may be situated on different sides of the supporting structure 2. The supporting structure 2 then can have a recess 11 for the coupling of locking element 3 and function element 6. For this, an engagement contour 3*c*, which can be formed on the locking element 3, especially the pawl 3*b*, or on the function element 6, can protrude through the recess 11. In the sample embodiment, the engagement contour 3*c* is formed on the pawl 3*b* or a lever coupled to the pawl 3*b*. Here, it is covered by the function element 6.

The free-movement path F and the actuation path B can run alongside each other. In the sample embodiment, the free-movement path F and the actuation path B run alongside each other, offset in a direction transversely to the axis of rotation $S_A$, $S_B$ of a locking element 3. In addition or alternatively, the free-movement path F and the actuation path B may also run alongside each other in the direction of the axis of rotation $S_A$, $S_B$ of a locking element 3. The free-movement path F and the actuation path B may run in parallel next to each other.

For the guiding of the actuating element 9, the function element 6 here has a guide contour 6*b*. In some embodiments, the guide contour 6*b* has a steady trend. The guide contour 6*b* may be formed as a cylinder segment, as shown in the sample embodiment.

The function element 6 according to another sample embodiment, not shown, may be configured in the manner of a switch and, with a guide contour 6*b*, guide the actuating element 9 either into the free-movement path F and/or the actuation path B.

In some embodiments, the guide contour 6*b* is surface-treated, especially coated, in order to assure a good sliding of the actuating element 9 along the guide contour 6*b*. In some embodiments, the guide contour 6*b* is coated with plastic material.

Furthermore, the engagement contour 9*a* of the actuating element 9 may also be surface-treated, especially coated. In some embodiments, the engagement contour 9*a* of the actuating element 9 is coated with a plastic material.

The plastic material for the forming of the guide contour 6*b* and/or the engagement contour 9*a* may be a thermoplastic polyester elastomer (TPE) and/or a polymer bearing material. In this context, the commercially available materials Hytrel® 4774, Hytrel® 5526, Hytrel® 6356 from DuPont® or Riteflex® 677 from Ticona® have proven to be especially suitable as the thermoplastic polyester elastomer.

The commercially available materials Iglidur® G, Iglidur® W 300 and Iglidur® J from Igus® have proven to be especially suitable as the polymer bearing material.

Here, the function element 6 in one function position guides the actuating motion of the actuating element 9 by releasing the actuating motion of the actuating element 9 in the actuation path B. In this embodiment, the function element 6 in another function position guides the actuating motion of the actuating element 9 on the free-movement path F, such as by blocking the actuation path B. In some embodiments, the function element as previously described guides either on the actuation path B or the free-movement path F.

In addition or alternatively it may be provided that the function element 6 in one function position releases the actuating motion of the actuating element 9 on the free-movement path F. In this embodiment, the function element 6 in another function position guides the actuating motion of the actuating element 9 on the actuation path B, such as by blocking the free-movement path F. In some embodiments, the function element as previously described guides either on the actuation path B or the free-movement path F.

In one modification of the disclosure it is proposed that the motor vehicle lock 1 comprises a spring assembly 12 acting on the actuating element 9. The spring assembly 12 may have a leg spring. Here, the spring assembly 12 prestresses the actuating element 9 against the function element 6. In this way, a movement tendency of the actuating element 9 can be produced upon actuation. In the sample embodiment, the spring assembly 12 produces a movement tendency of the actuating element 9 on the actuation path B.

Here, the actuating element 9 may have a slide block 9*b* for guiding the movement of the actuating element 9. The slide block 9*b* can be guided at least partly in a slide, not shown. In some embodiments, the slide provides at least one movement guidance on a portion of the actuation path B and/or on a portion of the free-movement path F. In some embodiments, the slide has a closed design and provides a movement guidance for both the free-movement path F and the actuation path B. In the sample embodiment, the slide provides a movement guidance for the actuation path B and the free-movement path F, while the function element 6 guides, by blocking or releasing, the actuating element 9 either on the actuation path B or the free-movement path F.

In the sample embodiment shown, the lock mechanism 5 provides the functions "locked" and "unlocked", especially through the respective function position of the function element 6.

Figure 2:
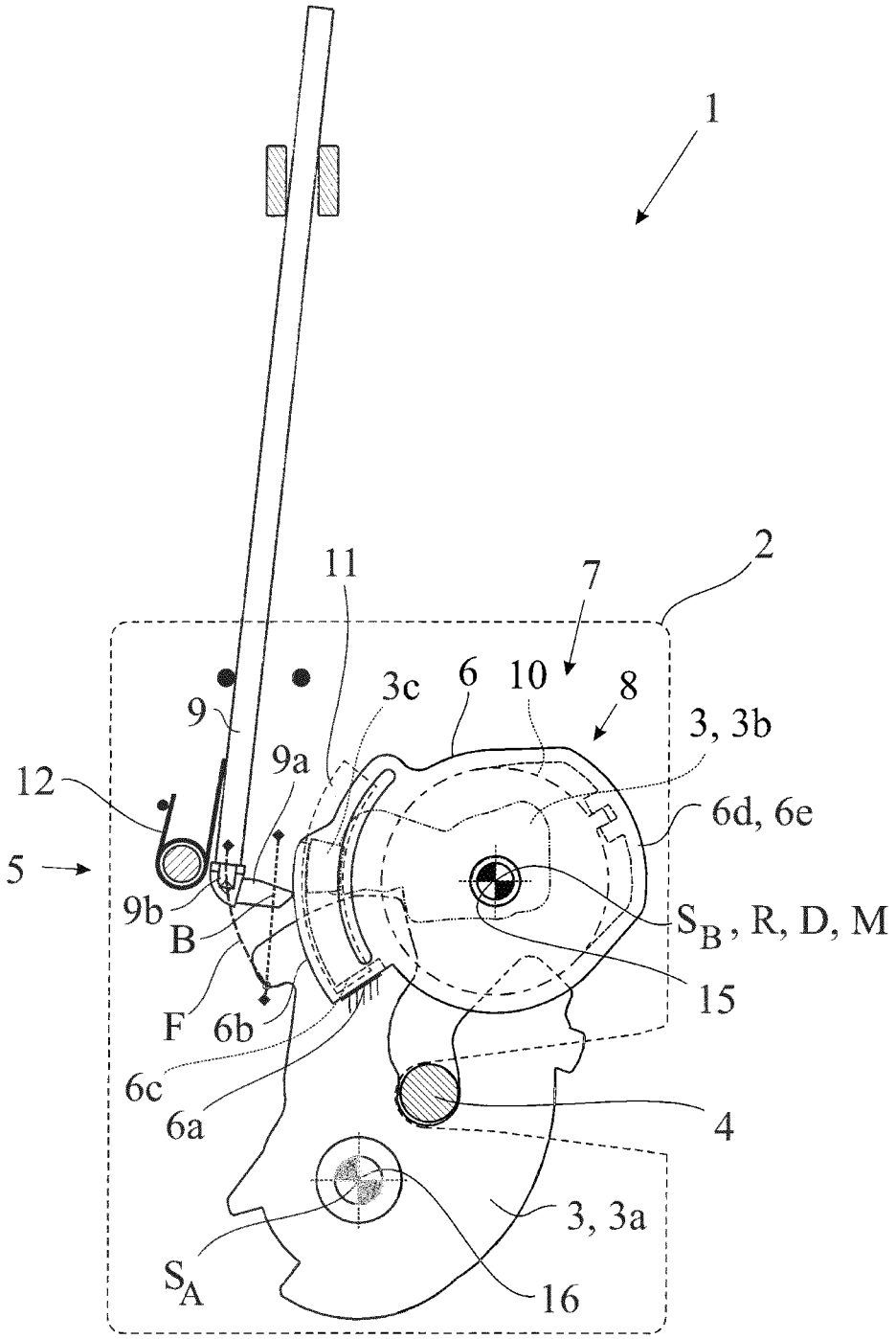

FIGS. 1 and 2 show the function element 6 in a "locked" function position. The function element 6 blocks the actuation path B to the actuating element 9. Upon actuating of the actuating element 9, the latter is pressed by the spring assembly 12 against the function element 9 and slides along the function element 9. The actuating element 9 is guided on the free-movement path F by virtue of the guiding force deriving from the function element 6, which here is an opposing force for the actuating element 9. Here, the guiding force acts perpendicular to the direction of movement of the actuating element 9.

On the free-movement path, the locking element 3 cannot be lifted off by the actuating element 9, since it is held out of engagement with the actuating element 9.

Figure 3:
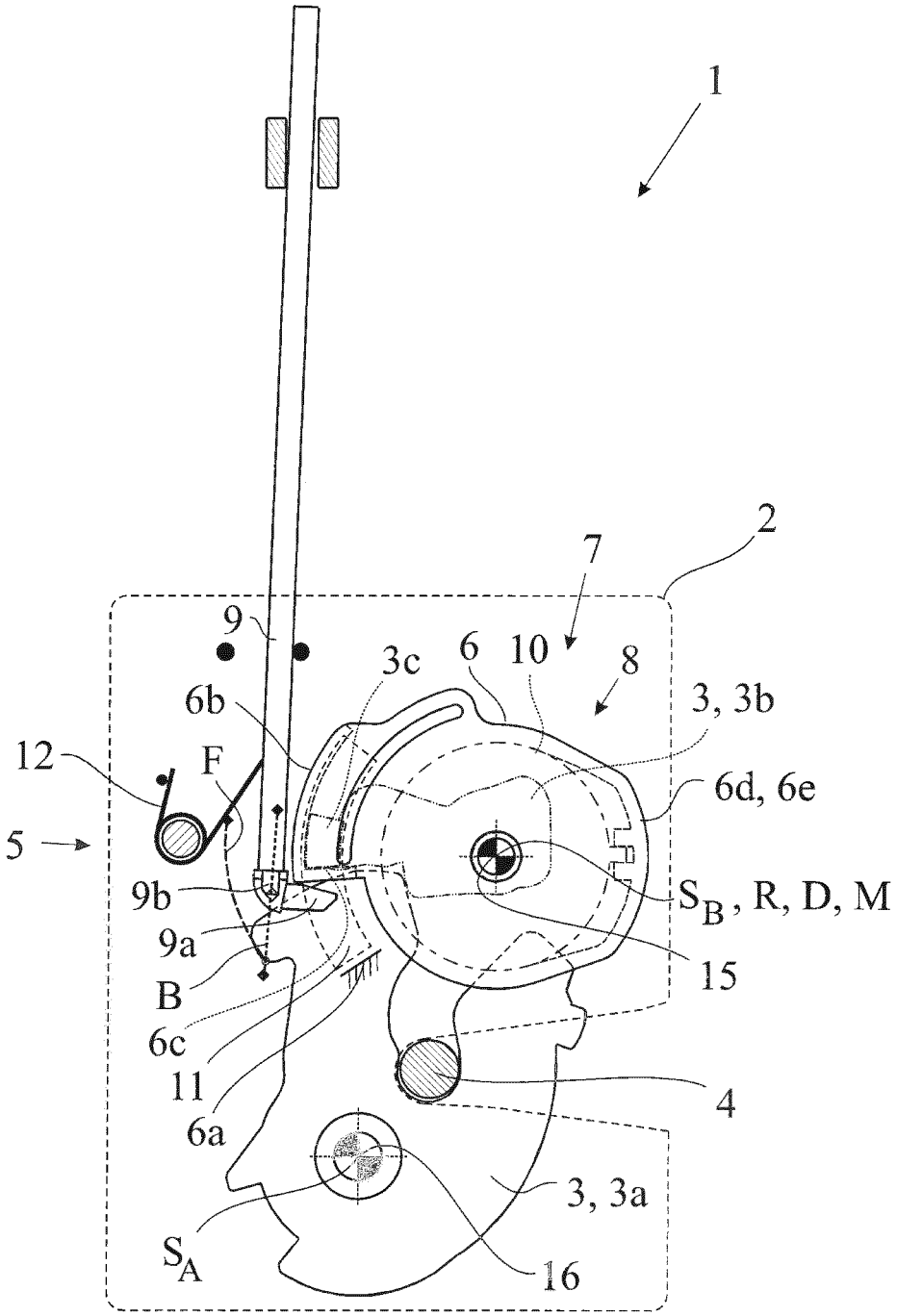
Figure 4:
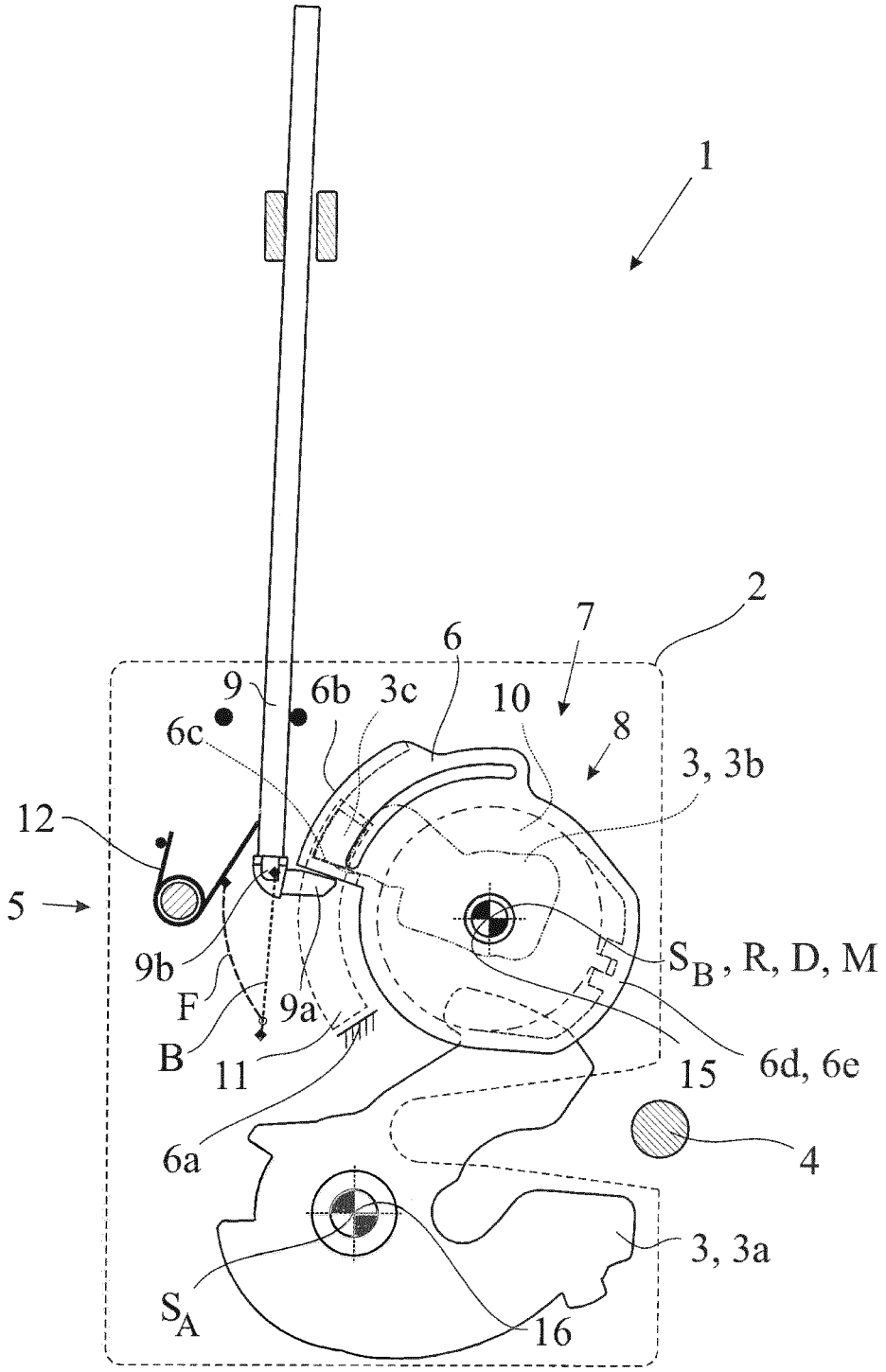

FIG. 3 shows the function element 6 in an "unlocked" function position. Upon actuating the actuating element 9, the actuating element 9 is pressed by the spring assembly 12 against the actuation path B. The function element 6 guides the actuating element 9 by releasing the actuation path B for the actuating element 9. The actuating element 9 lifts up the locking element 3 by the actuating motion on the actuation path B, as shown in FIG. 4. Upon actuating of the locking element 3, 3*a*, 3*b*, here the actuating element 9 acts on the locking element 3 in gear-free manner. "Gear-free" means here that the locking element 3, 3*a*, 3*b* acts on the locking element 3 without the interpositioning of a gear, in particular a lever gear.

The actuating element 9 in the sample embodiment acts by its actuating contour 9*a* indirectly on the locking element 3, in the present case the pawl 3*b*, by way of an acting contour 6*c*. The acting contour 6*c* here is formed on the function element 6.

According to another sample embodiment, the actuating element 9 can also act directly on the locking element 3, especially the pawl 3*b*.

Alternatively to the above described kinematics, in a kinematic reversal the function element 6 may also block the release path F in an "unlocked" function position and the spring assembly 12 in a "locked" function position may press the actuating element against the release path F and the function element 6 may release the release path F.

In some embodiments, the lock mechanism 5 additionally provides the "child protection" function and/or the "theft protection" function, especially likewise through a function position of the function element 6.

The mentioned function states can involve the possibility of opening a closure element of a motor vehicle by means of an inner door handle and by means of an outer door handle. In the "locked" function state, opening can be done from the inside, but not from the outside. In the "unlocked" function state, opening can be done both from the inside and the outside. In the "theft protection" function state, opening cannot be done either from the inside or the outside. In the "child protection" function state, unlocking can be done from the inside, but opening cannot be done from either the inside or the outside.

Moreover, a crash safety can be provided in an especially simple manner in the proposed motor vehicle lock 1. The motor vehicle lock 1 is configured and designed so that in an "unlocked" function position the inertia of the actuating element 9 produces a movement of the actuating element 9 on the free-movement path F when the speed of the actuating motion exceeds a speed threshold, and a movement of the actuating element 9 on the actuation path B when the speed of the actuating motion falls below a speed threshold. This is the case in the sample embodiment shown. The actuating element 9 during a normal actuating is guided on the actuation path B and lifts the pawl 3*b*. In a crash situation, when particularly high accelerations occur, the actuating element 9 will move very fast, while its inertia prevents the spring assembly 12 from moving the actuating element in the actuation path B, even though the function element 6 has released the actuation path B in itself. Therefore, the actuating element 9 in a crash situation will move in the free-movement path F. The pawl 3*b* is not lifted and the closure element of the motor vehicle remains closed.

In some embodiments, the drive 10 which drives the function element 6 is designed as a direct drive. In a direct drive, no gear transmission is arranged between the drive 10 and the function element 6.

In addition or alternatively, the drive assembly 7 may be at least partly integrated in the function element 6. For example, the coils 13 or permanent magnets 14 of the drive 10 may be integrated in the function element 6, for example, by injecting the function element 6 around the coils 13 and/or permanent magnets 14 in the injection-molding process. Generally, the function element 6 and the drive 10 may be joined together by force locking and/or form fit and/or material bonding or be integrated in each other.

In the represented sample embodiment, the drive 10 is designed as a claw pole motor. However, it may also be designed according to another drive concept.

In some embodiments, the function element 6 can move in rotation and/or linear movement between its function positions. In the sample embodiment shown, the function element 6 is moved by rotation between its function positions.

The axis of rotation R of the function element 6 is oriented parallel, especially coaxially, to the axis of rotation $S_A$, $S_B$ of a locking element 3 and/or to the axis of turning D of the drive 10. In the sample embodiment, the axis of rotation R of the function element 6 is oriented coaxially to the axis of rotation $S_B$ of the pawl 3*b*. In addition, the axis of turning D of the drive is oriented coaxially to the axis of rotation $S_B$ of the pawl 3*b*. This makes possible an especially compact design of the motor vehicle lock 1.

In some embodiments, the motor vehicle lock 1 has at least one bearing bolt 15, 16, about which the function element 6 can move in rotation. The bearing bolt 15, 16 may at the same time form the stator material 10*a* of the drive 10. In such an embodiment, the coils 13 of the drive 10 are arranged about the bearing bolt 15, 16. In addition, the pawl 3*b* or the latch 3*a* may also be mounted on the bearing bolt 15, 16. In some embodiments, the force flow of the guiding force is diverted outside of the drive train 8 of the drive assembly 7 by the bearing bolt 15, 16.

In addition or alternatively it may be provided that the function element 6 is guided in form fit over at least a portion and in particular at least a part of the force flow of the guiding force runs across the form fit. Moreover, the motor vehicle lock 1 may have an end stop, not shown, by which the force flow of the guiding force is diverted outside of the drive train of the drive assembly. In the latter case, the end stop can interact with the guide contour 6*b*. In this case, the end stop may provide a guidance for the function element 6 at the same time.

In order to keep the forces needed for the movement of the function element 6 as low as possible, here it is provided that the axis of rotation R of the function element 6 is distant at most by 2 cm, such as by at most 1 cm, from the center of mass M of the function element 6. In the represented sample embodiment, the axis of rotation R of the function element 6 is led through the center of mass M of the function element 6.

Any mass displacement caused by the guide contour 6*b* is compensated by a contour 6*d* situated opposite the guide contour 6*b*.

The motor vehicle lock 1 as described above may have a further actuating element for opening the motor vehicle lock 1. In some embodiments, the further actuating element 9 acts on the function element 6 to open the motor vehicle lock 1. For this purpose, the function element 6 may have an additional actuating contour 6*e*, by which the pawl 3*b* can be lifted. In some embodiments, the contour 6*d* situated opposite the guide contour 6*b* and the actuating contour 6*e* are formed together on the function element 6.

Here, the actuating element 9 and optionally the further actuating elements 9 may comprise a rod and/or a Bowden cable.

Figure 5:
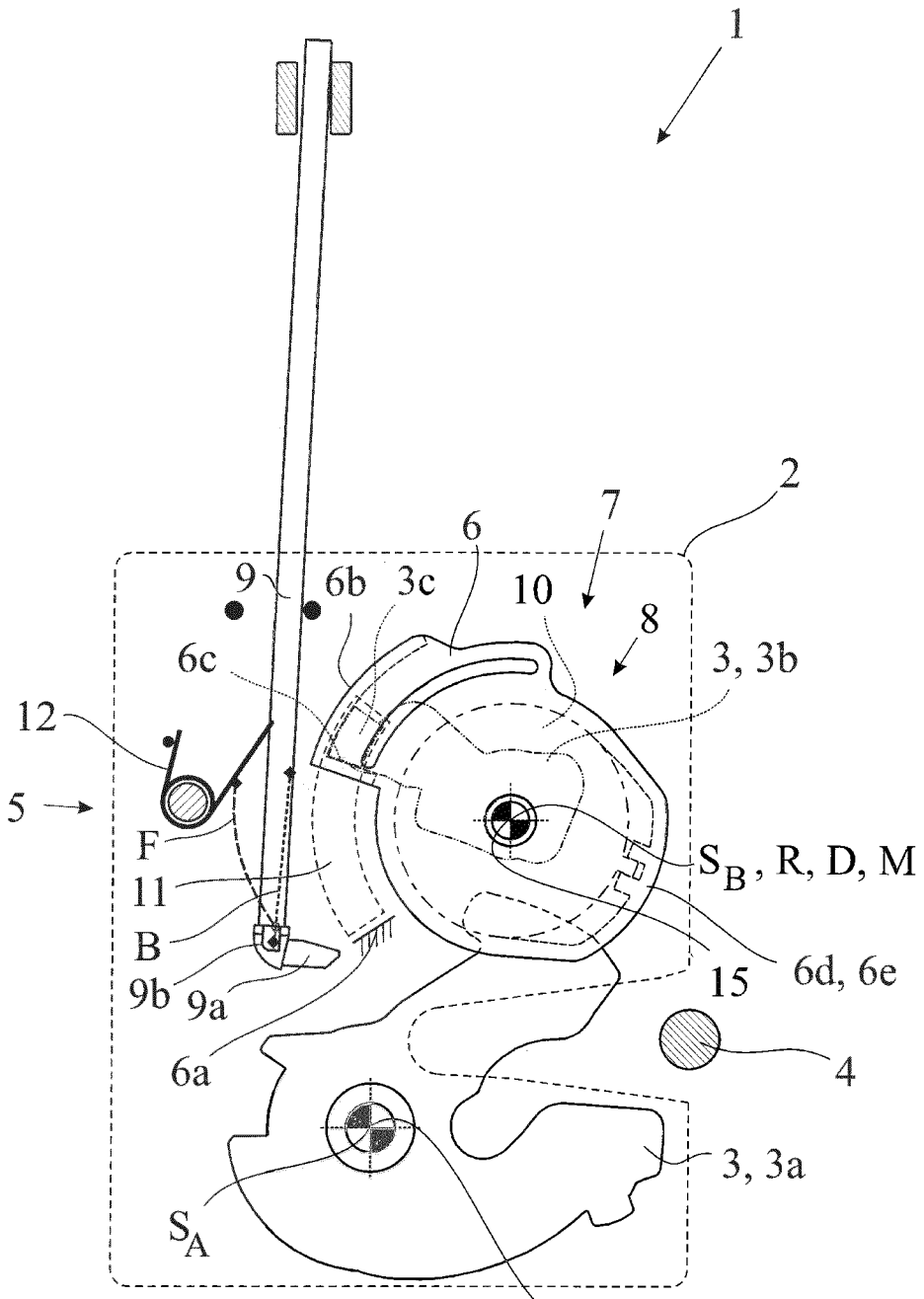

Moreover, the function element 6 can have an acting contour 6*c* by which the drive 10 can lift the pawl 3*b*, as shown in FIG. 5. In this way, an auxiliary opening drive can be provided especially easily for the motorized lifting of the pawl 3*b*.

The proposed motor vehicle lock 1 has a simple and compact construction. Because the force flow of the guiding force runs outside of the drive train 8 of the drive assembly 7, the function element 6 can be moved with a very weak drive 10. Consequently, not only an especially compact, but also an economical design of the motor vehicle lock 1 is possible.

The invention claimed is:

1. A motor vehicle lock with a supporting structure for holding at least one locking element and a lock mechanism, wherein the lock mechanism can be put into different function states and, for this purpose, has a function element that can be moved into different function positions corresponding to the function states, wherein a drive assembly having a drive train to the function element is provided for the motorized adjustment of the function element, wherein an actuating element is provided, by an actuating motion of which said locking element can be actuated, wherein the function element in one function position guides the actuating motion of the actuating element either into a free-movement path, in which the actuating element moves freely, or into an actuation path, in which the actuating element actuates the locking element, and for this purpose the function element applies a guiding force to the actuating element to guide the actuating motion of the actuating element, a force flow of which guiding force runs outside of the drive train of the drive assembly, wherein the function element has a guide contour for guiding the actuating element, and wherein the guide contour is formed as a cylinder segment.

2. The motor vehicle lock as claimed in claim 1, wherein the locking element which is actuated on the actuation path by the actuating element is a pawl.

3. The motor vehicle lock as claimed in claim 1, wherein the actuating element in the actuating of the locking element acts on the locking element in gear-free manner, and/or that the actuating element in the actuating of the locking element acts directly on the locking element.

4. The motor vehicle lock as claimed in claim 1, wherein the free-movement path and the actuation path run alongside each other.

5. The motor vehicle lock as claimed in claim 4, wherein the free-movement path and the actuation path run in the direction of an axis of rotation of the locking element or run alongside each other offset transversely to the axis of rotation of the locking element.

6. The motor vehicle lock as claimed in claim 1, wherein the function element in one function position releases the actuating motion of the actuating element in the free-movement path or releases it in the actuation path.

7. The motor vehicle lock as claimed in claim 1, wherein the motor vehicle lock comprises a spring assembly acting on the actuating element.

8. The motor vehicle lock as claimed in claim 7, wherein the spring assembly prestresses the actuating element on the actuation path.

9. The motor vehicle lock as claimed in claim 7, wherein the spring assembly prestresses the actuating element in at least one function position of the function element against the function element.

10. The motor vehicle lock as claimed in claim 1, wherein the lock mechanism comprises a locked function and an unlocked function, through function positions of the function element.

11. The motor vehicle lock as claimed in claim 10, wherein the motor vehicle lock is configured and designed such that, in an unlocked function position, the inertia of the actuating element produces a movement of the actuating element on the free-movement path if the speed of the actuating motion exceeds a speed threshold, and produces a movement of the actuating element on the actuation path if the speed of the actuating motion is below a speed threshold.

12. The motor vehicle lock as claimed in claim 10, wherein the motor vehicle lock further comprises a child protection function and/or a theft protection function through function positions of the function element.

13. The motor vehicle lock as claimed in claim 1, wherein the drive drives the function element in the manner of a direct drive and/or wherein the drive assembly is at least partly integrated in the function element.

14. The motor vehicle lock as claimed in claim 1, wherein the function element is moved by rotation and/or in linear motion between its function positions, wherein an axis of rotation of the function element is oriented parallel to an axis of rotation of the locking element and/or to an axis of turning of the drive.

15. The motor vehicle lock as claimed in claim 14, wherein the axis of rotation of the function element is at most 2 cm distant from the center of mass of the function element or wherein the axis of rotation of the function element leads through the center of mass of the function element.

16. The motor vehicle lock as claimed in claim 1, wherein the motor vehicle lock comprises a bearing bolt, around which the function element can move in rotation.

17. The motor vehicle lock as claimed in claim 16, wherein the bearing bolt forms the stator material or wherein the force flow of the guiding force is diverted by the bearing bolt outside of the drive train of the drive assembly.

18. The motor vehicle lock as claimed in claim 1, wherein the motor vehicle lock comprises another actuating element for opening the motor vehicle lock, wherein the other actuating element for opening the motor vehicle lock acts on the function element.

19. The motor vehicle lock as claimed in claim 1, wherein the actuating element comprises a rod and/or a Bowden cable or is designed as a rod or Bowden cable.

20. The motor vehicle lock as claimed in claim 1, wherein the guide contour is surface-treated with a plastic material.

* * * * *